United States Patent [19]

Noguchi et al.

[11] Patent Number: 4,622,127

[45] Date of Patent: Nov. 11, 1986

[54] METHOD FOR THE HYDROGENATION TREATMENT OF A HEAVY HYDROCARBON OIL

[75] Inventors: Yuji Noguchi, Sodegaura; Yuzuru Itoh, Ichihara, both of Japan

[73] Assignee: Research Association for Residual Oil Processing, Tokyo, Japan

[21] Appl. No.: 719,365

[22] Filed: Apr. 3, 1985

[30] Foreign Application Priority Data

Apr. 16, 1984 [JP] Japan ..... 59-75028

[51] Int. Cl.[4] ..... C10G 47/16; C10G 65/12

[52] U.S. Cl. ..... 208/58; 208/97; 208/216 PP; 208/217; 502/64; 502/66; 502/305; 502/325

[58] Field of Search ..... 208/111, 59, 97, 216 PP, 208/58, 217, 325; 502/64, 66, 305, 313

[56] References Cited

U.S. PATENT DOCUMENTS

| | | | |
|---|---|---|---|
| 4,191,635 | 3/1980 | Quick et al. | 208/216 PP |
| 4,395,328 | 7/1983 | Hensley, Jr. et al. | 208/216 PP |
| 4,395,329 | 7/1983 | Le Page et al. | 208/216 PP |
| 4,421,633 | 12/1983 | Shih et al. | 208/216 PP |
| 4,435,278 | 3/1984 | Chen | 208/216 PP |
| 4,440,631 | 4/1984 | Togari et al. | 208/112 |
| 4,465,789 | 8/1984 | Lindsley | 208/216 PP |

*Primary Examiner*—Andrew H. Metz
*Assistant Examiner*—Anthony McFarlane
*Attorney, Agent, or Firm*—Frishauf, Holtz, Goodman & Woodward

[57] ABSTRACT

A method for the two-step catalytic hydrogenation treatment of a heavy hydrocarbon oil which comprises first contacting the heavy hydrocarbon oil with a first solid catalyst comprising a metal component having catalytic activity for hydrogenation supported on a zeolite having catalytic activity for cracking a hydrocarbon, said zeolite having a (i) pore size distribution curve with two peaks, one peak in the range of 5 to 50 nm pore diameter and the other peak in the range of 50 to 1000 nm pore diameter and (ii) the volume of the pores having a diameter of 100 nm or larger is at least 0.05 ml/g; and then contacting the heavy hydrocarbon oil which had been contacted with said first catalyst, with a second catalyst, said second catalyst having hydrogenation activity and which is different from said first catalyst.

4 Claims, 4 Drawing Figures

METHOD FOR THE HYDROGENATION TREATMENT OF A HEAVY HYDROCARBON OIL

BACKGROUND OF THE INVENTION

The present invention relates to a method for the hydrogenation treatment of a heavy hydrocarbon oil and, more particularly, to a method, in a two-step process for the hydrogenation treatment of a heavy hydrocarbon oil by use of a catalyst, by which the hydrogenation treatment can be effected and continued over a long period of time with high efficiency and stability by use of a specific catalyst in the first-step treatment.

Several processes are known in the prior art for the hydrogenation treatment of a heavy hydrocarbon oil including, for example, a method in which the heavy hydrocarbon oil is first demetallized followed by desulfurization, a method of successive desulfurization and hydrogenative cracking of the heavy hydrocarbon oil and a method using two kinds of catalysts having different relative activities for the desulfurization and demetallization reactions.

None of these prior art methods, however, is quite satisfactory in respect of the efficiency of the treatment and the stability of the reaction in long-term running of the process.

SUMMARY OF THE INVENTION

It is therefore an object of the present invention to provide a novel and improved method for the hydrogenation treatment of a heavy hydrocarbon oil in which an outstandingly high efficiency of the treatment can be ensured with stability over a long period of time.

The method of the present invention is characterized, in the two-step hydrogenation treatment of a heavy hydrocarbon oil, by the use of a solid catalyst comprising a catalytically active component supported on an inorganic oxide carrier having a large volume of macropores in the first step of the two-step hydrogenation treatment.

Thus, the method of the present invention comprises, in a two-step hydrogenation treatment of a heavy hydrocarbon oil, contacting the heavy hydrocarbon oil, in the first step of the two-step treatment, with a solid catalyst comprising a metal component having an activity for the hydrogenation supported on an inorganic oxide carrier having an activity for the crackinq of a hydrocarbon, of which the volume of the pores having a diameter of 100 nm or larger is at least 0.05 ml/g.

DETAILED DESCRIPTION OF THE PREFERRED EMBODIMENTS

Figure 1:
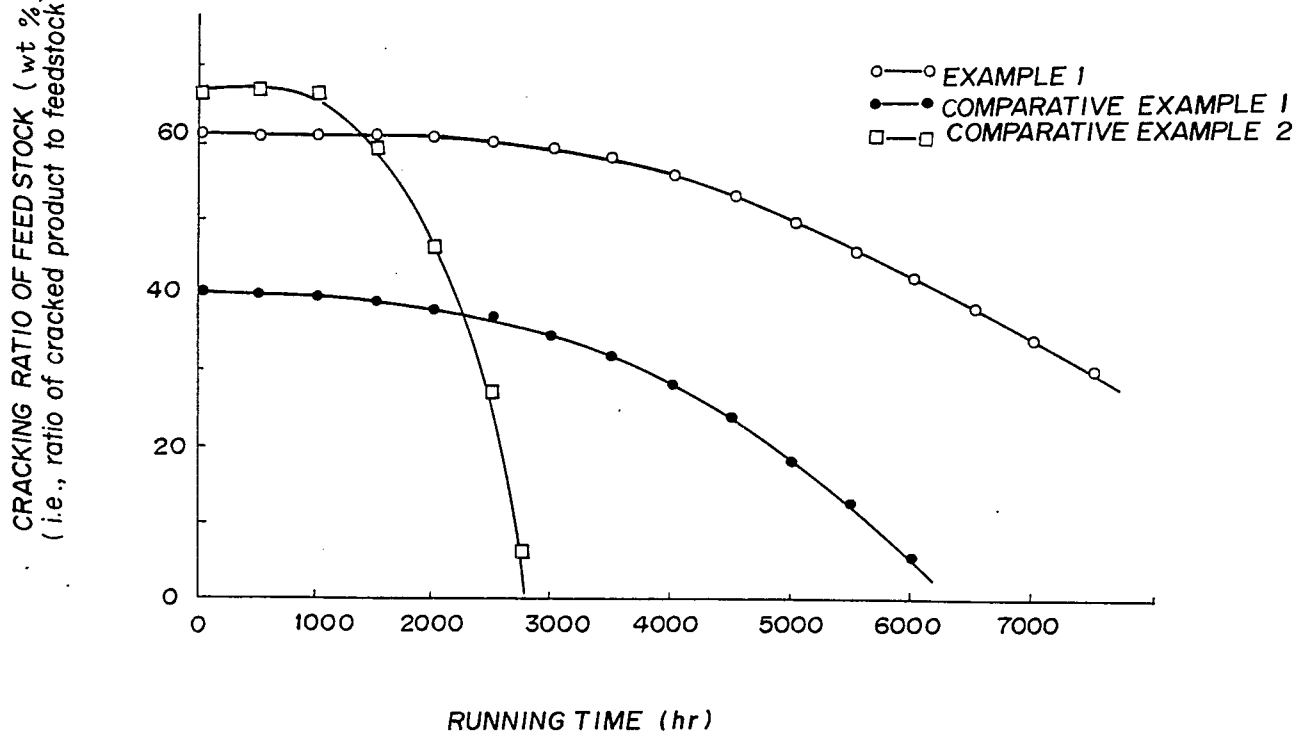
FIG. 1 is a graph illustrating the % cracking of the feed stock as a function of the overall length of time of running with oil supply (see Example 1).

The solid catalyst used in the first step of the inventive two-step hydrogenation treatment of a heavy hydrocarbon oil is formed of a specific inorganic oxide carrier supporting a catalytically active metal component thereon. As is mentioned above, the inorganic oxide carrier should have activity for the cracking of a hydrocarbon, and the volume of pores having a diameter of 100 nm or larger should be at least 0.05 ml/g. Exemplary of such an inorganic oxide suitable as the carrier are the Y-type or faujasite-type zeolite, ultrastable Y-type or USY-type zeolite, iron-containing Y-type zeolite, silica-alumina and the like.

The above mentioned catalyst carrier of inorganic oxide should have such a porosity that the volume of the macropores, i.e. pores having a diameter of 100 nm or larger or, in particular, in the range from 100 to 1000 nm, is at least 0.05 or, preferably, at least 0.08 ml/g of the inorganic oxide. It is also a preferable condition that the pore size distribution curve of the inorganic oxide carrier has two maxima (i.e. peaks) in the ranges of 5 to 50 nm and 50 to 1000 nm of the pore diameter.

The inorganic oxide should have activity for the cracking of a hydrocarbon or, in other words, should contain a solid acid or other active entity capable of cracking a hydrocarbon at a high temperature.

Particularly suitable examples of the inorganic oxide carrier include the faujasite-type iron-containing alumino-silicate zeolite described in Japanese Patent Kokai No. 59-196745 and the USY-type zeolite described in Japanese Patent Kokai No. 59-193137.

The catalytically active metal component supported on the inorganic oxide carrier may be selected from a variety of metallic elements having activity for hydrogenation depending on the type of the heavy hydrocarbon oil under treatment, the process conditions undertaken and other factors. Usually, the metal component is one or more metals selected from the metallic elements belonging to the VIB Group and the VIII Group of the Periodic Table. Although the metallic elements belonging to either the VIB Group or the VIII Group can be used alone, it is preferable to use at least one VIB Group element and at least one VIII Group element in combination. Typically, the VIB Group metallic element should be tungsten or molybdenum and the VIII Group metallic element should be nickel or cobalt. The metallic elements of either Group can be used jointly.

The amount of the active metallic ingredient supported on the inorganic oxide carrier is not particularly limitative depending on various factors and conditions. Usually, the amount should be in the range from 3 to 24% by weight or, preferably, from 8 to 20% by weight for the metallic element belonging to the VIB Group of the Periodic Table and in the range from 0.7 to 20% by weight or, preferably, from 1.5 to 8% by weight for the metallic element belonging to the VIII Group of the Periodic Table based on the overall amount of the catalyst.

In the preparation of the solid catalyst, any known method such as coprecipitation and impregnation is applicable for forming the active metallic ingredient on the inorganic oxide carrier.

The first step treatment of the inventive two-step hydrogenation treatment of a heavy hydrocarbon oil is performed by use of the above described solid catalyst having very high activity for the hydrogenation along with the catalyst carrier having a large number of macropores. Therefore, a very high reaction conversion can be obtained in the proceeding of each of the demetallization reaction and the hydrogenation cracking reaction when the hydrogenation treatment of the heavy hydrocarbon oil is performed by use of the specific catalyst. Moreover, the macropores in the catalyst carrier are effective for the prolongation of the catalyst life to a great extent due to the decreased poisoning of the active metallic ingredient by the metallic constituents contained in the heavy hydrocarbon oil.

Excepting for the essential use of the above described specific solid catalyst, the other conditions in the first step of the inventive two-step hydrogenation treatment may be conventional and selected from wide ranges including the reaction conditions hitherto undertaken in the hydrogenation treatment or, in particular, in the hydrogenation cracking of heavy hydrocarbon oils. Usually, the preferable reaction conditions in the first step of the inventive method include a reaction temperature in the range from 350° to 450° C., a reaction pressure in the range from 50 to 200 kg/cm$^2$, a feed ratio of hydrogen to the feed oil in the range from 400 to 3000 Nm$^3$-$H_2$/kl-oil and a liquid hourly space velocity (LHSV) in the range from 0.1 to 2.0 hour$^{-1}$. The purity of the hydrogen feed is preferably at least 75% by moles.

In the inventive method, the above described first-step hydrogenation treatment is followed by the second-step hydrogenation treatment in which any catalyst having an activity for the hydrogenation can be used according to the particular object including, for example, the catalysts having activities for the reactions of hydrogenation desulfurization, hydrogenation denitrification, hydrogenation demetallization, hydrogenation deasphaltenation, hydrogenation dewaxing, hydrogenation reforming, hydrogenation cracking and tne like.

The reaction conditions in this second step hydrogenation treatment should of course be determined in accordance with the type of the catalyst, the type of the desired reaction and the like within the ranges including, for example, a reaction temperature in the range from 250° to 400° C., a reaction pressure in the range from 10 to 200 kg/cm$^2$, a feed ratio of hydrogen to the feed oil in the range from 300 to 3000 Nm$^3$$H_2$/kl oil and a LHSV value in the range from 0.1 to 3.0 hour$^{-1}$ when the type of the desired reaction is mainly the hydrogenation desulfurization. When the type of the desired reaction is mainly the hydrogenative cracking, on the other hand, the typical reaction conditions should include a reaction temperature in the range from 300° to 500° C., a reaction pressure in the range from 80 to 200 kg/cm$^2$, a feed ratio of hydrogen to the feed oil in the range from 500 to 3000 Nm$^3$$H_2$/kl oil and a LHSV value in the range from 0.1 to 3.0 hour$^{-1}$. The purity of the hydrogen gas feed in this case can be as low as 75% by moles.

When the two-step hydrogenation treatment of a heavy hydrocarbon oil is performed according to the inventive method in the above described manner, high quality lighter hydrocarbon oils as desired can be produced with a very high efficiency and stability of running. The feed heavy hydrocarbon oils to which the inventive method is applicable include residual oils from the atmospheric or reduced pressure distillation of crude oils, reduced-pressure gas oils, residual oils by catalytic cracking, visbreaking oils, tar sand oils, shale oils and the like.

An advantage obtained by the method of the invention is that the demetallization reaction proceeds with a greatly decreased, if not completely prevented, catalyst poisoning by virtue of the use of a catalyst prepared of a specific catalyst carrier having a large volume of macropores in the first step of the two-step hydrogenation treatment. As a consequence, both of the catalysts used in the first and second steps of the hydrogenation treatment can retain their catalytic activity at a high level for a long period of time.

Therefore, the method of the present invention provides the possibility of an efficient hydrogenation treatment of any heavy-grade hydrocarbons, which can hardly be processed in the conventional methods due to the rapid degradation of the catalytic activity, over a long period of continuous running to give lighter hydrocarbon oils of high quality as desired.

In the following, the method of the present invention is described in more detail by way of examples preceded by the description of the preparation of the catalysts used in the examples.

PREPARATION 1

A solid catalyst, referred to as catalyst A hereinbelow, was prepared in the following manner. Thus, 140 g of a Y-type zeolite substituted with ammonium ions containing 0.12% by weight of $Na_2O$ were subjected to self-steaming by keeping for 3 hours at 680° C. in a rotary kiln and, after cooling, then contacted with 1.4 liters of an aqueous solution of iron (III) nitrate in a concentration of 0.1 mole/liter at 50° C. for 2 hours followed by washing with water and calcination at 450° C. for 3 hours. The properties of the thus prepared catalyst A, i.e. an iron-containing zeolite catalyst, are shown in Table 1 below.

PREPARATION 2

A solid catalyst, referred to as catalyst B hereinbelow, was prepared in the following manner. Thus, 1400 g of a $NH_4Y$-type zeolite containing 0.45% by weight of $Na_2O$ were subjected to self-steaming by keeping at 680° C. for 3 hours in a rotary kiln and, after cooling, contacted with 14 liters of a 0.1 N aqueous nitric acid solution at 50° C. for 2 hours followed by filtration, washing with water, drying and calcination at 450° C. for 3 hours. The properties of the thus prepared catalyst B are shown in Table 1 below.

PREPARATION 3

Solid catalysts, referred to as catalyst C and catalyst E hereinbelow, were prepared according to the procedure described in Example 1 of Japanese Patent Kokai No. 57-30550 and in Example 1 of Japanese Patent Kokai No. 53-120691, respectively. The properties of these catalysts C and E are shown in Table 1, which also includes the properties of a commercially available catalyst for the pre-treatment of hydrogenation, which is referred to as catalyst D hereinbelow.

TABLE 1

| | Catalyst A | Catalyst B | Catalyst C | Catalyst D | Catalyst E |
|---|---|---|---|---|---|
| Composition Ratio | | | | | |
| $Al_2O_3$ (wt %) | 36.6 | 36.1 | 35.8 | 6.0 | 87.8 |
| $SiO_2$ (wt %) | 43.0 | 45.1 | 45.2 | 58.2 | — |
| MgO (wt %) | — | — | — | 25.6 | — |
| CoO (wt %) | — | — | — | 2.4 | 1.4 |
| $MoO_3$ (wt %) | — | — | — | 7.8 | 10.3 |

TABLE 1-continued

| | Catalyst A | Catalyst B | Catalyst C | Catalyst D | Catalyst E |
|---|---|---|---|---|---|
| NiO (wt %) | 3.6 | 3.7 | 3.8 | — | 0.5 |
| $WO_3$ (wt %) | 15.1 | 15.2 | 15.2 | — | — |
| $Fe_2O_3$ (wt %) | 2.0 | — | — | — | — |
| Properties | | | | | |
| Specific Surface Area*[1] ($m^2/g$) | 149 | 161 | 131 | 140 | 252 |
| Pore Volume*[2] (ml/g) | 0.52 | 0.55 | 0.35 | 0.78 | 0.58 |
| Pore Distribution (ml/g) | | | | | |
| 35 ~ 100Å | 0.17 | 0.20 | 0.13 | 0.04 | 0.38 |
| 100 ~ 200Å | 0.07 | 0.06 | 0.14 | 0.16 | 0.17 |
| 200 ~ 300Å | 0.03 | 0.04 | 0.03 | 0.26 | 0.01 |
| 300 ~ 600Å | 0.05 | 0.06 | 0.04 | 0.29 | 0.01 |
| 600 ~ 1000Å | 0.06 | 0.04 | 0.01 | 0.02 | 0.00 |
| > 1000Å | 0.14 | 0.15 | 0.00 | 0.01 | 0.00 |

*[1]measured by Hg adsorption method
*[2]measured by Hg pressure injection method

EXAMPLE 1

A tubular reactor was filled with equal volumes of the catalyst A in the upper half and the catalyst C in the lower half. The reactor was heated at a temperature of 410° C. and the hydrogenation treatment of a residual oil in the atmospheric pressure distillation of a Kuwait crude oil was undertaken therein by introducing the feed oil (said residual oil) at the top of the reactor under the conditions of a LHSV value of 0.3 $hour^{-1}$, a feed ratio of hydrogen to the feed oil of 2000 $Nm^3/kl$ and a hydrogen partial pressure of 135 $kg/cm^2$. FIG. 1 of the accompanying drawing illustrates the % cracking of the feed oil (referred to in FIG. 1 as "cracking ratio of feedstock") calculated using the equation given below as a function of the overall length of running time with oil supply. Table 2 below summarizes the properties of the residual oil in the atmospheric pressure distillation used as the feed oil.

The cracking ratio of feed stock, $$\% \text{ by weight} = \frac{a - b \times c/d}{a} \times 100,$$

in which a is the content of the fraction boiling at 343° C. or higher in the feed oil in % by weight, b is the content of the fraction boiling at 343° C. or higher in the product oil in % by weight, c is the amount of the product oil in kilogram and d is the amount of the feed oil in kilogram.

TABLE 2

| | |
|---|---|
| Specific Gravity (15/4°C.) | 0.9726 |
| Viscosity (50° C.) (cSt) | 838 |
| Sulfur Content (wt %) | 4.14 |
| Nitrogen Content (ppm) | 1950 |
| Carbon Residue Content (wt %) | 11.8 |
| Water Content | trace |
| Composition Ratio (wt %) | |
| Asphalten | 7.8 |
| Resin | 10.2 |
| Aromatic Compound | 55.4 |
| Saturated Compound | 26.6 |
| Boiling Range | |
| IBP | 273° C. |
| 5% | 345° C. |
| 10% | 373° C. |
| 20% | 412° C. |
| 30% | 444° C. |
| 40% | 480° C. |
| 50% | 518° C. |
| 60% | 564° C. |
| Fraction having a boiling point of above 343° C. | 95.3 wt % |

COMPARATIVE EXAMPLE 1

The conditions for the hydrogenation treatment of the heavy hydrocarbon oil were substantially the same as in Example 1 described above except that the catalyst A filling the upper half portion of the tubular reactor was replaced with the same volume of the catalyst D. The relationship between the % cracking of the feed oil and the overall running time was as illustrated in FIG. 1.

COMPARATIVE EXAMPLE 2

The conditions for the hydrogenation treatment of the heavy hydrocarbon oil were substantially the same as in Example 1 described above except that the whole volume of the tubular reactor was filled with the catalyst C alone replacing the catalyst A filling the upper half portion of the reactor with the catalyst C. The relationship between the cracking of the feed oil and the overall running time was as illustrated in FIG. 1.

EXAMPLE 2

Figure 2:
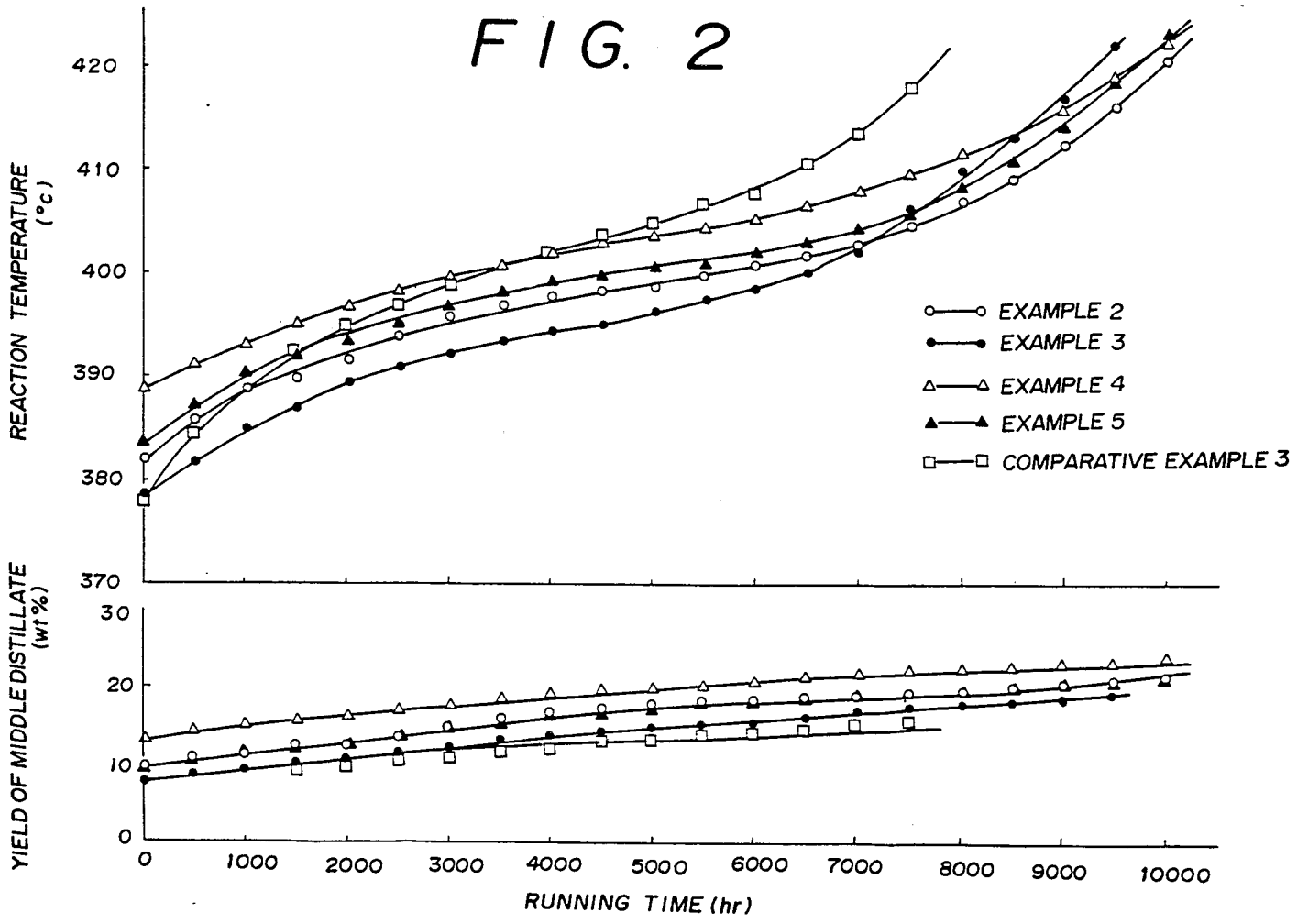
FIGS. 2 to 4 are each a graph illustrating the reaction temperature and the yield of the middle distillate each as a function of the overall running time with oil supply (see Examples 2 to 5).
Figure 3:
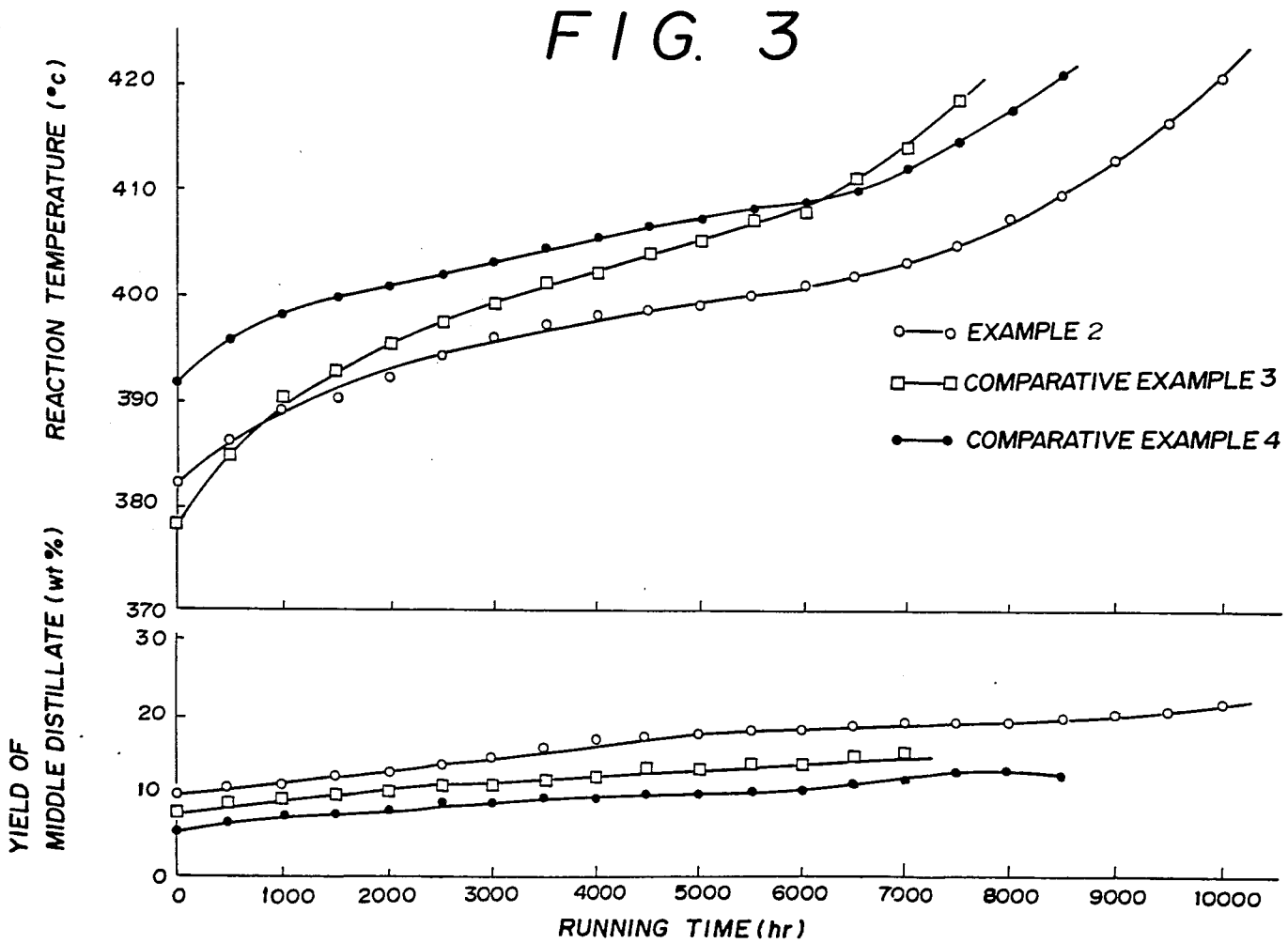

A tubular reactor was filled with equal volumes of the catalyst A in the upper half and the catalyst E in the lower half. The hydrogenation treatment of the same residual oil as used in Example 1 was performed by passing the oil from the top to the bottom of this tubular reactor under the conditions of a hydrogen partial pressure of 135 $kg/cm^2$, a LHSV value of 0.3 $hour^{-1}$ and a feed ratio of hydrogen gas to the feed oil of 1000 $Nm^3/kl$. The tubular reactor was kept at such a temperature that 90% desulfurization was obtained. FIGS. 2 and 3 graphically illustrate the reaction temperature and the yield of the middle distillate, respectively, as a function of the overall running time. The middle distillates here implied include the distilled oils having a boiling point in the range from 171° to 343° C. such as the distillate of kerosene and gas oil.

EXAMPLE 3

Figure 4:
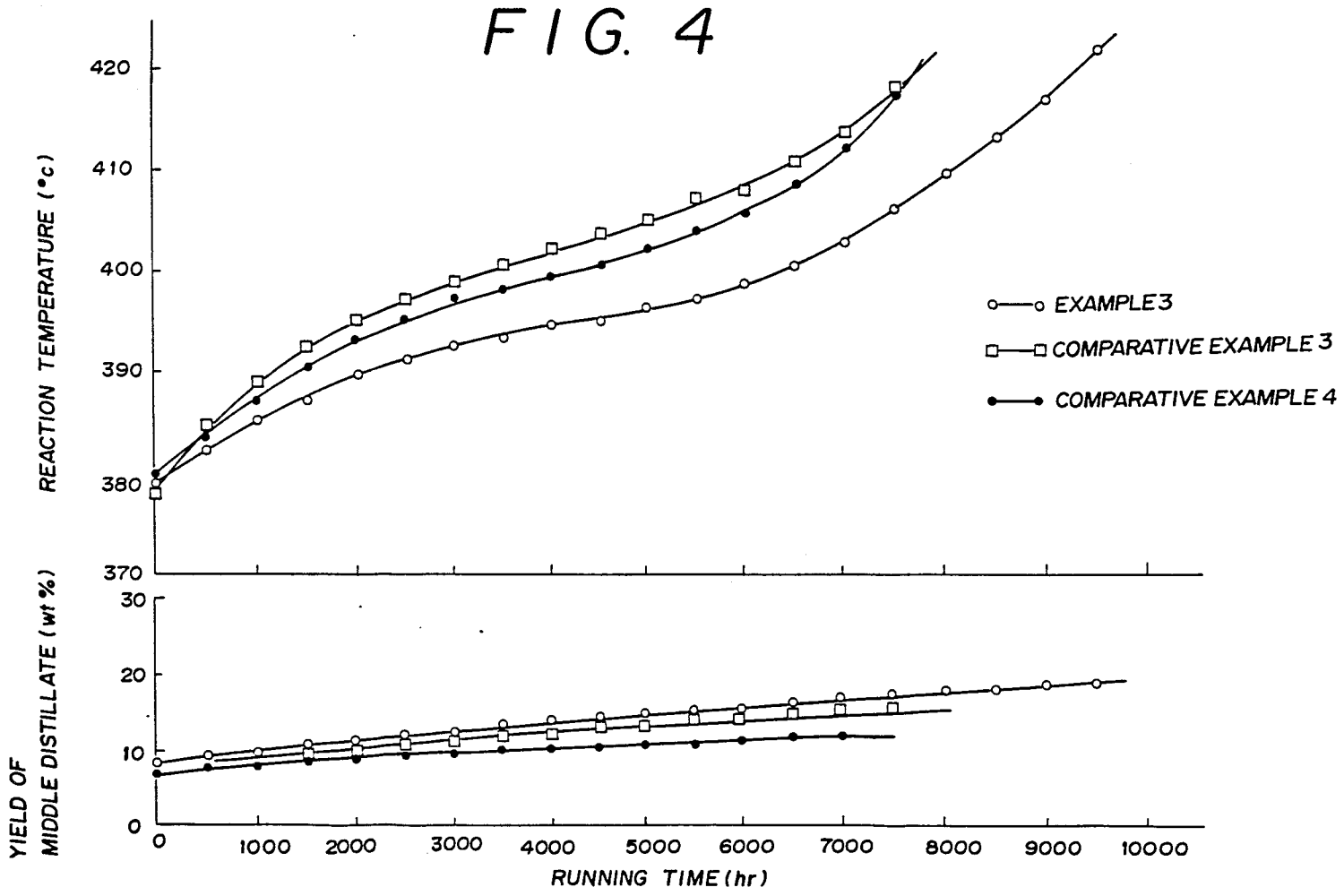

The conditions for the hydrogenation treatment of the heavy hydrocarbon oil were substantially the same as in Example 2 except that the tubular reactor was filled with the catalyst A in the upper one-fifth portion and with the catalyst E in the lower four-fifths portion of the whole volume. The results are shown in FIGS. 2 and 4.

EXAMPLE 4

The conditions for the hydrogenation treatment of the heavy hydrocarbon oil were substantially the same as in Example 2 except that the tubular reactor was filled with the catalyst A in the upper seven-tenths portion and with the catalyst E in the lower three tenths portion of the whole volume. The results are shown in FIG. 2.

EXAMPLE 5

The conditions for the hydrogenation treatment of the heavy hydrocarbon oil were substantially the same as in Example 2 except that the catalyst A filling the upper half portion of the tubular reactor was replaced with the same volume of the catalyst B. The results are shown in FIG. 2.

COMPARATIVE EXAMPLE 3

The conditions for the hydrogenation treatment of the heavy hydrocarbon oil were substantially the same as in Example 2 except that the whole volume of the tubular reactor was filled with the catalyst E in place of the combination of the catalysts A and E. The results are shown in FIGS. 2 to 4.

COMPARATIVE EXAMPLE 4

The conditions for the hydrogenation treatment of the heavy hydrocarbon oil were substantially the same as in Example 2 except that the catalyst A filling the upper half portion of the tubular reactor was replaced with the same volume of the catalyst D. The results are shown in FIGS. 3 and 4.

What is claimed is:

1. A method for the two-step catalytic hydrogenation treatment of a heavy hydrocarbon oil which comprises first contacting the heavy hydrocarbon oil with a first solid catalyst comprising a metal component having catalytic activity for hydrogenation supported on a zeolite having cataytic activity for cracking a hydrocarbon, said zeolite having a (i) pore size distribution curve with two peaks, one peak in the range of 5 to 50 nm port diameter and the other peak in the range of 50 to 1000 nm pore diameter and (ii) the volume of the pores having a diameter of 100 nm or larger is at least 0.05 ml/g; whereby a hydrocracked product is formed; and then contacting said hydrocracked product with second catalyst, said second catalyst being a catalyst having hydrogenation activity and which is different from said first catalyst, whereby a hydrogenated product is formed.

2. The method of claim 1 wherein the volume of the pores of said zeolite having a diameter of 100 nm or larger is at least 0.08 ml/g.

3. The method of claim 2 wherein in said first solid catalyst, said metal component having catalytic activity for hydrogenation belongs to the VIB Group of the Periodic Table and is in an amount from 8 to 20% by weight of said first solid catalyst.

4. The method of claim 2 wherein in said first solid catalyst, said metal component having catalytic activity for hydrogenation belongs to the VIII Group of the Periodic Table and is in an amount from 1.5 to 8% by weight of said first solid catalyst.

* * * * *

UNITED STATES PATENT AND TRADEMARK OFFICE

CERTIFICATE OF CORRECTION

PATENT NO. : 4,622,127

DATED : November 11, 1986

INVENTOR(S) : NOGUCHI et al

It is certified that error appears in the above-identified patent and that said Letters Patent is hereby corrected as shown below:

Column 8, line 12 (Claim 1), after "ml/g", change ";" to --,--

Column 8, line 14 (Claim 1), after "with" insert --a--.

Column 8, line 16 (Claim 1), after "which is", insert --a--.

Column 8, line 17 (Claim 1), before "from said" insert --catalyst--.

Signed and Sealed this

Twelfth Day of January, 1993

*Attest:*

DOUGLAS B. COMER

*Attesting Officer*

*Acting Commissioner of Patents and Trademarks*